US006260214B1

(12) United States Patent
Smith

(10) Patent No.: US 6,260,214 B1
(45) Date of Patent: Jul. 17, 2001

(54) TOILET STOOL VENTILATION SYSTEM

(76) Inventor: David F. Smith, 941 Prescott, Fort Myers Beach, FL (US) 33931

( * ) Notice: Subject to any disclaimer, the term of this patent is extended or adjusted under 35 U.S.C. 154(b) by 0 days.

(21) Appl. No.: 09/572,883

(22) Filed: May 19, 2000

(51) Int. Cl.[7] ..... E03D 9/052
(52) U.S. Cl. ..... 4/213
(58) Field of Search ..... 4/213

(56) References Cited

U.S. PATENT DOCUMENTS

| | | | | |
|---|---|---|---|---|
| D. 355,960 | | 2/1995 | Galasso et al. . | |
| 2,124,017 | | 7/1938 | Vandiver . | |
| 2,297,035 | | 9/1942 | Svec . | |
| 2,728,088 | | 12/1955 | Gudish . | |
| 3,120,665 | * | 2/1964 | Kirkland | 4/213 |
| 3,357,029 | | 12/1967 | Schulz . | |
| 3,416,167 | | 12/1968 | Klemme . | |
| 3,523,309 | * | 8/1970 | Munden | 4/213 |
| 3,600,724 | | 8/1971 | Stamper et al. . | |
| 3,849,808 | | 11/1974 | Olson et al. . | |
| 5,488,741 | | 2/1996 | Hunnicutt, Jr. . | |
| 5,671,484 | * | 9/1997 | Lee, III | 4/213 |
| 5,745,927 | | 5/1998 | Hoareau . | |

* cited by examiner

*Primary Examiner*—Robert M. Fetsuga

(57) ABSTRACT

A toilet stool ventilation system for extracting objectionable and obnoxious odors from the toilet stool to the outside. The toilet stool ventilation system includes a vent member including a vent housing having an opening therein and being adapted to be fastenably disposed between a toilet bowl and a toilet seat with hook and loop fasteners and with the vent housing also including a hose adapter extending through a wall of the vent housing and extending outwardly thereof; and also includes a flexible tubular member having a first end and a second end which is removably and securely fastened to the hose adapter of the vent housing and also having a bore extending therethrough; and further includes an odor extracting assembly for extracting odors from a toilet stool through the vent member and the flexible tubular member.

14 Claims, 4 Drawing Sheets

19
20
21
11
13
22
27
26
23
18
44
46

30
34
33
36
49
39
35
28
31
24
23
29
40
32
38
37
41
42

TOILET STOOL VENTILATION SYSTEM

BACKGROUND OF THE INVENTION

1. Field of the Invention

The present invention relates to an immediate toilet odor removal system and more particularly pertains to a new toilet stool ventilation system for extracting objectionable and obnoxious odors from the toilet stool to the outside.

2. Description of the Prior Art

The use of an immediate toilet odor removal system is known in the prior art. More specifically, an immediate toilet odor removal system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,488,741; 3,849,808; 2,297,035; U.S. Pat. No. Des. 355,960; U.S. Pat. Nos. 3,600,724; and 3,416,167; 3,357,029; 2,728,088; 2,124,017; and 5,745,927.

While these devices fulfill their respective, particular objectives and requirements, the aforementioned patents do not disclose a new toilet stool ventilation system. The inventive device includes a vent member including a vent housing having an opening therein and being adapted to be fastenably disposed between a toilet bowl and a toilet seat with hook and loop fasteners and with the vent housing also including a hose adapter extending through a wall of the vent housing and extending outwardly thereof; and also includes a flexible tubular member having a first end and a second end which is removably and securely fastened to the hose adapter of the vent housing and also having a bore extending therethrough; and further includes an odor extracting assembly for extracting odors from a toilet stool through the vent member and the flexible tubular member.

In these respects, the toilet stool ventilation system according to the present invention substantially departs from the conventional concepts and designs of the prior art, and in so doing provides an apparatus primarily developed for the purpose of extracting objectionable and obnoxious odors from the toilet stool to the outside.

SUMMARY OF THE INVENTION

In view of the foregoing disadvantages inherent in the known types of immediate toilet odor removal system now present in the prior art, the present invention provides a new toilet stool ventilation system construction wherein the same can be utilized for extracting objectionable and obnoxious odors from the toilet stool to the outside.

The general purpose of the present invention, which will be described subsequently in greater detail, is to provide a new toilet stool ventilation system which has many of the advantages of the immediate toilet odor removal system mentioned heretofore and many novel features that result in a new toilet stool ventilation system which is not anticipated, rendered obvious, suggested, or even implied by any of the prior art immediate toilet odor removal system, either alone or in any combination thereof.

To attain this, the present invention generally comprises a vent member including a vent housing having an opening therein and being adapted to be fastenably disposed between a toilet bowl and a toilet seat with hook and loop fasteners and with the vent housing also including a hose adapter extending through a wall of the vent housing and extending outwardly thereof; and also includes a flexible tubular member having a first end and a second end which is removably and securely fastened to the hose adapter of the vent housing and also having a bore extending therethrough; and further includes an odor extracting assembly for extracting odors from a toilet stool through the vent member and the flexible tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet stool ventilation system which has many of the advantages of the immediate toilet odor removal system mentioned heretofore and many novel features that result in a new toilet stool ventilation system which is not anticipated, rendered obvious, suggested, or even implied by any of the prior art immediate toilet odor removal system, either alone or in any combination thereof.

It is another object of the present invention to provide a new toilet stool ventilation system which may be easily and efficiently manufactured and marketed.

It is a further object of the present invention to provide a new toilet stool ventilation system which is of a durable and reliable construction.

An even further object of the present invention is to provide a new toilet stool ventilation system which is susceptible of a low cost of manufacture with regard to both materials and labor, and which accordingly is then susceptible of low prices of sale to the consuming public, thereby making such toilet stool ventilation system economically available to the buying public.

Still yet another object of the present invention is to provide a new toilet stool ventilation system which provides in the apparatuses and methods of the prior art some of the advantages thereof, while simultaneously overcoming some of the disadvantages normally associated therewith.

Still another object of the present invention is to provide a new toilet stool ventilation system for extracting objectionable and obnoxious odors from the toilet stool to the outside.

Yet another object of the present invention is to provide a new toilet stool ventilation system which includes a vent member including a vent housing having an opening therein and being adapted to be fastenably disposed between a toilet bowl and a toilet seat with hook and loop fasteners and with the vent housing also including a hose adapter extending through a wall of the vent housing and extending outwardly thereof; and also includes a flexible tubular member having a first end and a second end which is removably and securely fastened to the hose adapter of the vent housing and also having a bore extending therethrough; and further includes an odor extracting assembly for extracting odors from a toilet stool through the vent member and the flexible tubular member.

Still yet another object of the present invention is to provide a new toilet stool ventilation system that is easy and convenient to install within one's bathroom.

Even still another object of the present invention is to provide a new toilet stool ventilation system that eliminates the need to use aerosol spray cans which has been determined to be unhealthy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

FIG. is a rear elevational view of the vent member of present invention securely fastened to a toilet stool.

Figure 1:
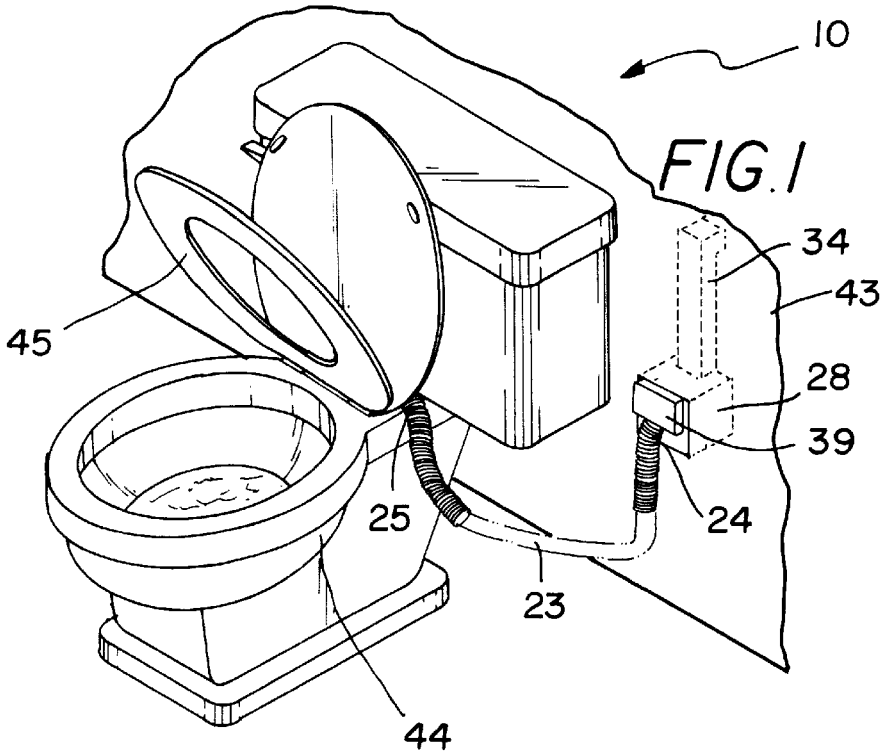
FIG. 1 is a perspective view of a new toilet stool ventilation system according to the present invention.
Figure 2:
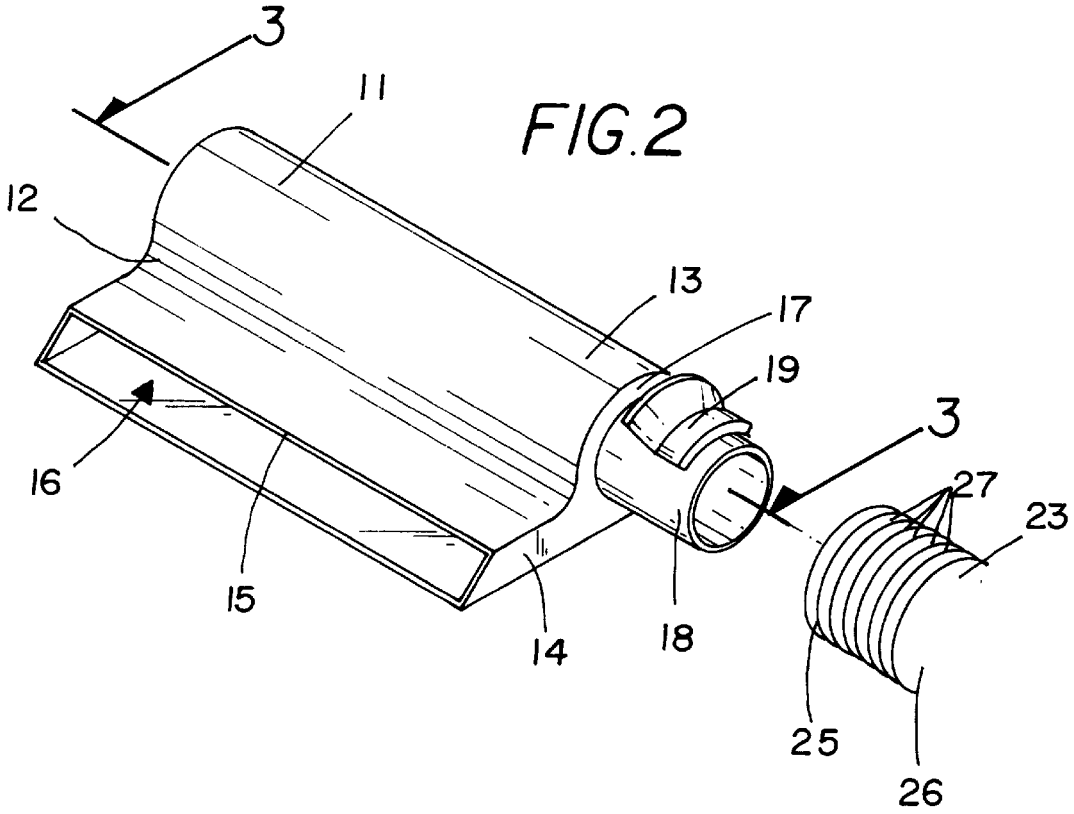
FIG. 2 is a detailed perspective view of vent member of the present invention.
Figure 3:
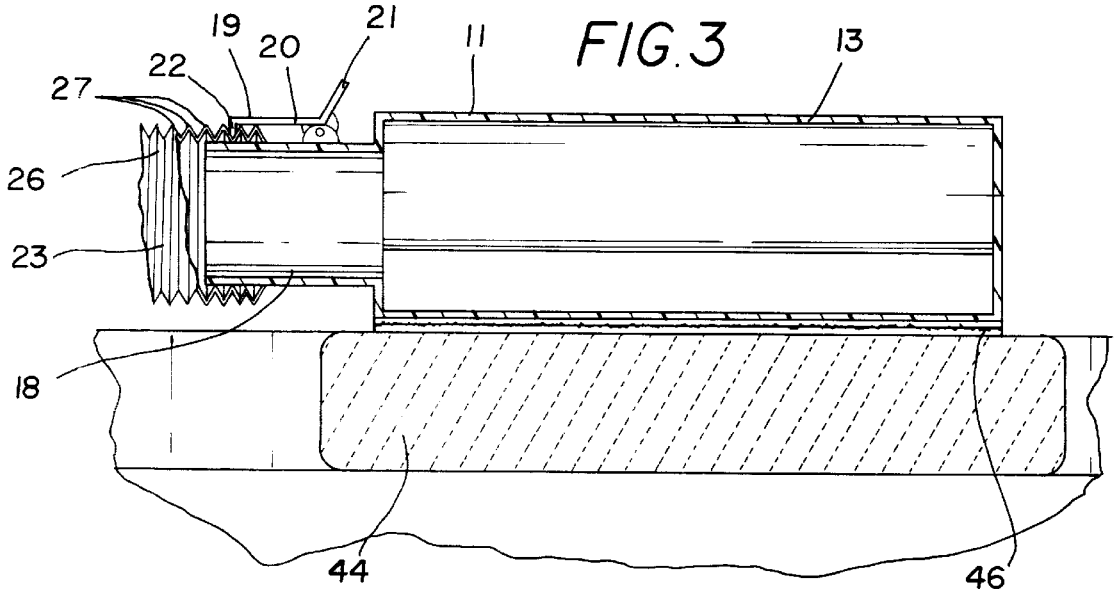

FIG. 3 is a perspective view of a first embodiment of the present invention.

Figure 4:
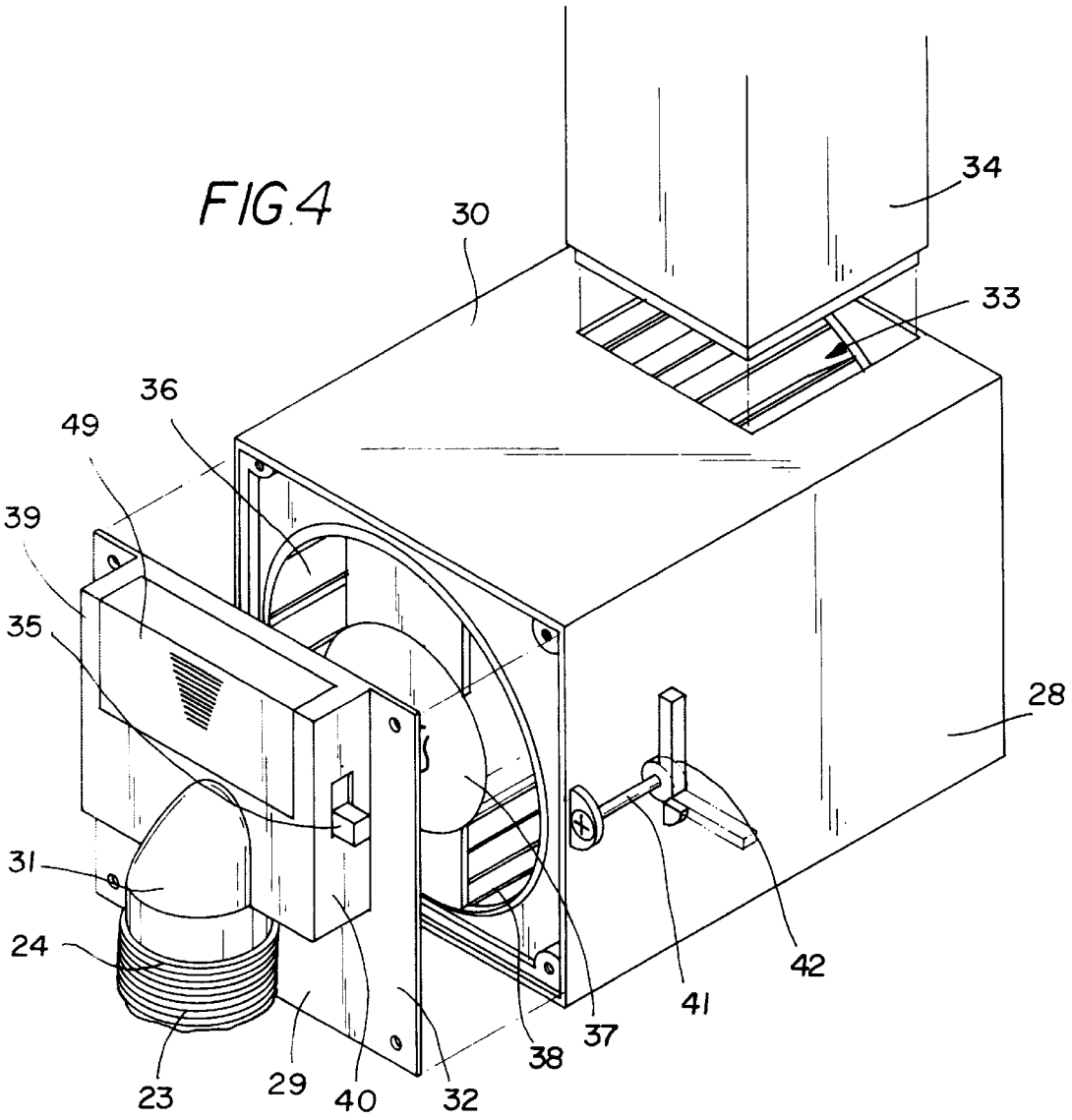

FIG. 4 is a cross-sectional view of a second embodiment of the present invention.

Figure 5:
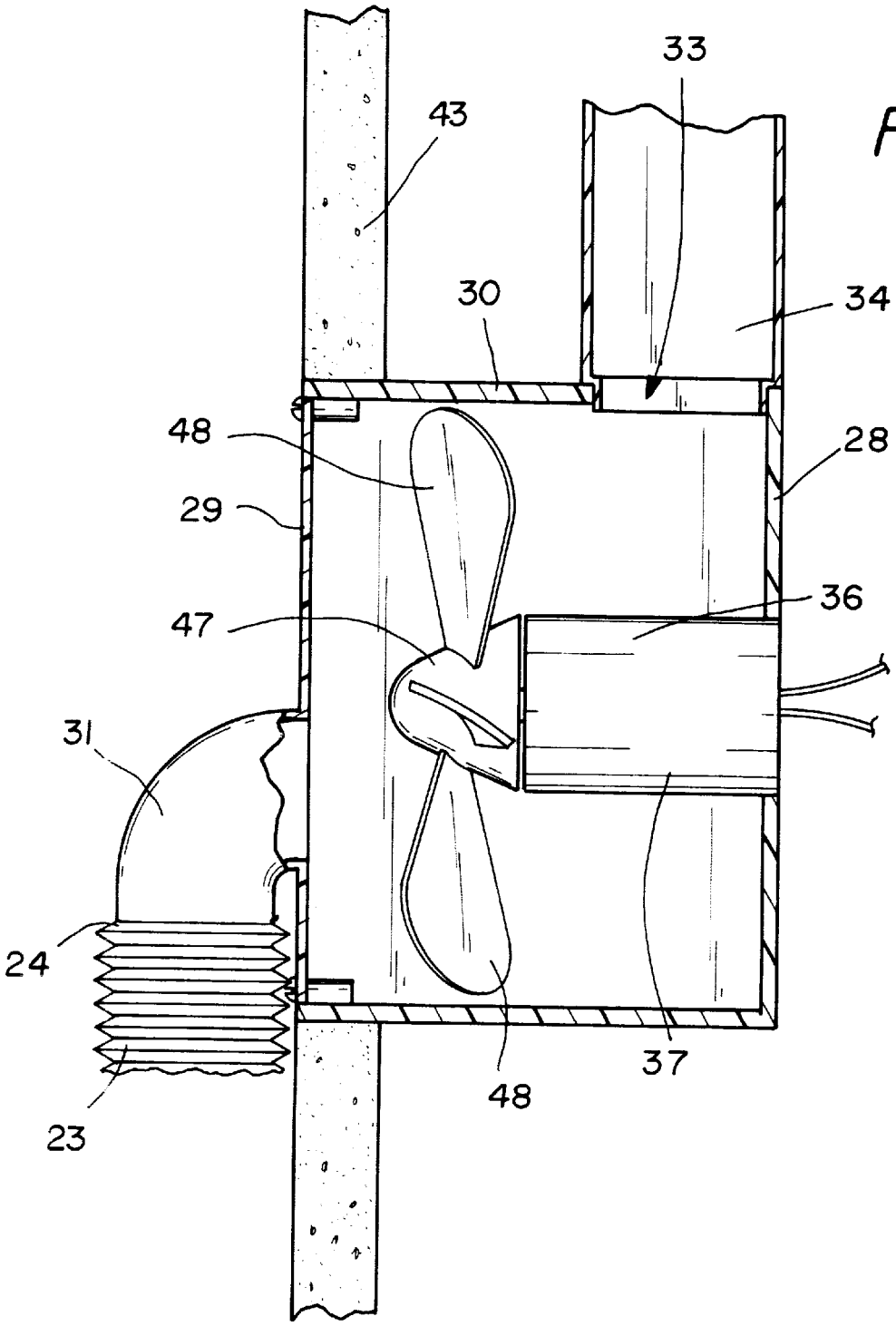

FIG. 5 is a cross-sectional view of a second embodiment of the present invention.

DESCRIPTION OF THE PREFERRED EMBODIMENT

With reference now to the drawings, and in particular to FIGS. 1 through 5 thereof, a new toilet stool ventilation system embodying the principles and concepts of the present invention and generally designated by the reference numeral 10 will be described. 11 includes a first portion 13 and a channel portion 14 which is integrally connected to the first portion 13 with the first portion 13 being enlarged relative to the channel portion 12. The channel portion 12 includes a longitudinal end 15 through which the opening 16 extends. The hose adapter 18 extends through an end wall 17 of the first portion 13.

A flexible tubular member 23 has a first end 24 and a second end 25 which is removably and securely fastened to the hose adapter 18 of the vent housing 11 and also has a bore extending therethrough. The hose adapter 18 includes a fastening means for fastening the flexible tubular member 23 thereto. The fastening means includes a spring-loaded clamping member 19 being hingedly and conventionally attached to an exterior of the hose adapter 18 with the spring-loaded clamping member 19 including a main portion 20, a handle portion 21 integrally attached to an end of and being angled from the main portion 20, and a tubular member engaging portion 22 being integrally attached to another end of and being angled from the main portion 20. The flexible tubular member 23 includes a second end portion 26 having a plurality of folds 27 extending thereabout with the folds 27 being spaced apart and being adapted to receive the tubular member-engaging portion 22 of the clamping member 19 therebetween for securely retaining the flexible tubular member 23 about the hose adapter 18.

A means for extracting odors from a toilet stool 44 through the vent member 11 and the flexible tubular member 23 includes a housing 28 being adapted to be securely mounted to a wall structure 43 proximate to the toilet stool 44 and having an intake duct 31 extending through a wall 29 thereof and also having an out-take port 33 extending though another wall 30 of the housing 28; and also includes a fan unit 36 securely disposed within the housing 28; and further includes a switch 35 accessibly disposed in a wall 40 of the housing 28 and being connected to the fan unit 36 for the energizing thereof; and also includes a power source 49 connected to the switch 35; and further includes an out-take duct 34 securely and conventionally mounted to the housing 28 over and upon the out-take port 33 thereof for passing odors to an outside; and further includes means for mounting the housing 28 to the wall structure 43. The means for mounting the housing 28 to the wall structure 43 includes fasteners each having an elongate member 41 being adapted to extend through the wall structure 43 and also having wall-engaging expandable member 42 attached to an end of the elongate member 41 and being adapted to engage the wall structure 43 to securely mount the housing 28 to the wall structure 43.

As a first embodiment, the housing 28 further includes a removable cover 32 with the intake duct 31 being disposed through the removable cover 32 and being securely and conventionally attached to the first end 24 of the flexible tubular member 23. The housing 28 also includes a battery compartment 39 securely disposed upon the removable cover 32 with the switch 35 being disposed in a wall 40 of the battery compartment 39 and with the fan unit 36 including a motor 37 and a centrifugal fan 38 rotatably mounted to the motor 37 for drawing odors from the toilet stool 44 to the outside.

As a second embodiment, the housing 28 further includes a removable cover 32 with the intake duct 31 being disposed through the removable cover 32 and being securely and conventionally attached to the first end 24 of the flexible tubular member 23 and with the fan unit 36 including a motor 37 and a fan member 47 rotatably mounted to the motor 37 and having a plurality of fan blades 48 for drawing odors from the toilet stool 44 to the outside.

In use, the energizes the motor 37 which turns the centrifugal fan 38 or fan member 47 on by turning on the switch 35. The centrifugal fan 38 or fan member 47 creates a suction through the flexible tubular member 23 and through the vent housing 12 which draws the odors from the toilet stool 44 to the outside through the out-take duct 34 which is attached to the housing 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet stool ventilation system comprising:

a vent member including a vent housing having an opening therein and being adapted to be fastenably disposed between a toilet bowl and a toilet seat with hook and loop fasteners, said vent housing also including a hose adapter extending through a wall of said vent housing and extending outwardly thereof;

a flexible tubular member having a first end and a second end which is removably and securely fastened to said hose adapter of said vent housing, and also having a bore extending therethrough; and a means for extracting odors from a toilet stool through said vent member and said flexible tubular member, said means for extracting odors including a housing and mounting means for mounting said housing to a wall structure, said mounting means comprising an elongate member adapted for extending through the wall structure, and a wall-engaging member being attached to an end of said elongate member and being rotatable with the elongate member for engaging the wall structure to secure said housing to the wall structure.

2. A toilet stool ventilation system as described in claim 1, wherein said vent housing includes a first portion and a channel portion which is integrally connected to said first portion with said first portion being enlarged relative to said channel portion.

3. A toilet stool ventilation system as described in claim 2, wherein said channel portion includes a longitudinal end through which said opening extends.

4. A toilet stool ventilation system as described in claim 1, wherein said hose adapter extends through an end wall of said first portion and includes a fastening means for fastening said flexible tubular member thereto.

5. A toilet stool ventilation system as described in claim 4, wherein said fastening means includes a spring-loaded clamping member being hingedly attached to an exterior of said hose adapter, said spring-loaded clamping member including a main portion, a handle portion integrally attached to an end of and being angled from said main portion, and a tubular member-engaging portion being integrally attached to another end of and being angled from said main portion.

6. A toilet stool ventilation system as described in claim 5, wherein said flexible tubular member includes a second end portion having a plurality of folds extending thereabout, said folds being spaced apart and being adapted to receive said tubular member-engaging portion of said clamping member therebetween for securely retaining said flexible tubular member about said hose adapter.

7. A toilet stool ventilation system as described in claim 6, wherein said housing has an intake duct extending through a wall structure thereof and also having an out-take port extending though another wall of said housing; and also includes a fan unit securely disposed within said housing; and further includes a switch accessibly disposed in a wall of said housing and being connected to said fan unit for the energizing thereof; and also includes a power source connected to said switch; and further includes an out-take duct securely mounted to said housing upon said out-take port thereof for passing odors to an outside.

8. A toilet stool ventilation system as described in claim 7, wherein said housing further includes a removable cover, said intake duct being disposed through said removable cover and being securely attached to said first end of said flexible tubular member.

9. A toilet stool ventilation system as described in claim 8, wherein said housing also includes a battery compartment securely disposed upon said removable cover, said switch being disposed in a wall of said battery compartment.

10. A toilet stool ventilation system as described in claim 7, wherein said fan unit includes a motor and a centrifugal fan rotatably mounted to said motor for drawing odors from the toilet stool to the outside.

11. A toilet stool ventilation system as described in claim 7, wherein said fan unit includes a motor and a fan member rotatably mounted to said motor and having a plurality of fan blades for drawing odors from the toilet stool to the outside.

12. A toilet stool ventilation system comprising:

a vent member including a vent housing having an opening therein and being adapted to be fastenably disposed between a toilet bowl and a toilet seat with hook and loop fasteners, said vent housing also including a hose adapter extending through a wall of said vent housing and extending outwardly thereof, said vent housing including a first portion and a channel portion which is integrally connected to said first portion with said first portion being enlarged relative to said channel portion, said channel portion including a longitudinal end through which said opening extends, said hose adapter extending through an end wall of said first portion;

a flexible tubular member having a first end and a second end which is removably and securely fastened to said hose adapter of said vent housing, and also having a bore extending therethrough, said hose adapter including a fastening means for fastening said flexible tubular member thereto, said fastening means including a spring-loaded clamping member being hingedly attached to an exterior of said hose adapter, said spring-loaded clamping member including a main portion, a handle portion integrally attached to an end of and being angled from said main portion, and a tubular member-engaging portion being integrally attached to another end of and being angled from said main portion, said flexible tubular member including a second end portion having a plurality of folds extending thereabout, said folds being spaced apart and being adapted to receive said tubular member-engaging portion of said clamping member therebetween for securely retaining said flexible tubular member about said hose adapter; and a means for extracting odors from a toilet stool through said vent member and said flexible tubular member including a housing being adapted to be securely mounted to a wall structure proximate to the toilet stool and having an intake duct extending through a wall thereof and also having an out-take port extending though another wall of said housing, and also including a fan unit securely disposed within said housing, and further including a switch accessibly disposed in a wall of said housing and being connected to said fan unit for the energizing thereof, and also including a power source connected to said switch, and further including an out-take duct securely mounted to said housing over and upon said out-take port thereof for passing odors to an outside, and further including means for mounting said housing to the wall structure, said means for mounting said housing to the wall structure including fasteners each having an elongate member being adapted to extend through the wall structure and also having wall-engaging expandable members attached to an end of said elongate member and being adapted to engage the wall structure to securely mount said housing to the wall structure.

13. A toilet stool ventilation system as described in claim 12, wherein said housing further includes a removable cover, said intake duct being disposed through said removable cover and being securely attached to said first end of said flexible tubular member, said housing also includes a battery compartment securely disposed upon said removable cover, said switch being disposed in a wall of said battery compartment, said fan unit including a motor and a centrifugal fan rotatably mounted to said motor for drawing odors from the toilet stool to the outside.

14. A toilet stool ventilation system as described in claim 12, wherein said housing further includes a removable cover, said intake duct being disposed through said removable cover and being securely attached to said first end of said flexible tubular member, said fan unit including a motor and a fan member rotatably mounted to said motor and having a plurality of fan blades for drawing odors from the toilet stool to the outside.

* * * * *